US011257639B2

(12) United States Patent
Wong

(10) Patent No.: US 11,257,639 B2
(45) Date of Patent: Feb. 22, 2022

(54) SNAP-ACTION SWITCH AND METHOD OF ASSEMBLING SAME

(71) Applicants: Defend Electech Co., Ltd, Dongguan (CN); Defend Components Limited, Chai Wan (HK)

(72) Inventor: Kin Yu Wong, Chai Wan (HK)

(73) Assignees: Defond Electech Co., Ltd, Dongguan (CN); Defond Components Limited, Chai Wan (HK)

( * ) Notice: Subject to any disclaimer, the term of this patent is extended or adjusted under 35 U.S.C. 154(b) by 0 days.

(21) Appl. No.: 16/706,493

(22) Filed: Dec. 6, 2019

(65) Prior Publication Data

US 2020/0185167 A1 Jun. 11, 2020

(30) Foreign Application Priority Data

Dec. 7, 2018 (HK) ..... 18115703.6

(51) Int. Cl.
*H01H 13/22* (2006.01)
*H01H 13/04* (2006.01)
(Continued)

(52) U.S. Cl.
CPC ..... *H01H 13/22* (2013.01); *H01H 13/04* (2013.01); *H01H 13/14* (2013.01); *H01H 13/50* (2013.01)

(58) Field of Classification Search
CPC ..... H01H 13/22; H01H 13/04; H01H 13/14; H01H 13/50; H01H 13/28; H01H 13/063;
(Continued)

(56) References Cited

U.S. PATENT DOCUMENTS 2,984,726 A * 5/1961 Roeser ..... H01H 13/14 200/302.2
3,905,246 A 9/1975 Breckenfelder
(Continued)

FOREIGN PATENT DOCUMENTS

CN 201536062 U 7/2010
CN 203055715 U 7/2013
(Continued)

OTHER PUBLICATIONS

Japanese Office Action, dated Feb. 24, 2021, for Japanese Application No. 2019215012, (with English Translation) 15 pages.
(Continued)

*Primary Examiner* — Lheiren Mae A Caroc
(74) *Attorney, Agent, or Firm* — Seed Intellectual Property Law Group LLP

(57) ABSTRACT

A snap-action switch including: a housing in which a plurality of fixed contacts and a plurality of movable contacts are disposed therein, a plunger configured for depressible movement via an aperture in the housing from a first position in which the plunger is relatively extended outwardly of the housing via the aperture, into, a second position in which the plunger is relatively retracted inwardly of the housing via the aperture; and a snap-action assembly operably-connected with the plunger, the snap-action assembly being responsive to depressible movement of the plunger so as to effect snap-action type movement of the plurality of movable contacts between normally opened and normally closed positions with respect to the fixed contacts; a sealing element configured for arrangement around the plunger to occlude ingress of particulates, dust and water from entering the housing via the aperture, the sealing element including a flanged portion; and a securement element configured for arrangement around the sealing element, wherein the securement element is shaped and dimensioned for interference
(Continued)

fitting or snap-fitting with a rim of the aperture whereby the flanged portion of the sealing element is secured between the securement element and the rim of the aperture so as to restrict removal of the sealing element from the housing.

15 Claims, 11 Drawing Sheets

(51) Int. Cl.
*H01H 13/14* (2006.01)
*H01H 13/50* (2006.01)

(58) Field of Classification Search
CPC ..... H01H 13/06; H01H 11/00; H01H 13/26; H01H 13/36; H01H 13/40; H01H 13/48; H01H 13/10; H01H 13/12; H01H 13/30; H01H 13/32; H01H 13/52; H01H 1/14; H01H 1/26; H01H 2001/265; H01H 3/02; H01H 3/12; H01H 3/32; H01H 2223/00; H01H 5/00; H01H 5/04; H01H 5/045; H01H 5/06; H01H 5/08; H01H 5/10; H01H 5/18; H01H 5/20; H01H 5/22; H01H 9/04; H01H 9/041; H01H 9/02; H01H 2009/048
USPC ..... 200/302.1, 302.2
See application file for complete search history.

(56) References Cited

U.S. PATENT DOCUMENTS

| | | | | |
|---|---|---|---|---|
| 4,902,863 | A | 2/1990 | Fukuma | |
| 5,134,259 | A * | 7/1992 | Page, Jr. | H01H 3/12 200/341 |
| 6,998,555 | B2 * | 2/2006 | Collot | H01H 13/36 200/412 |
| 7,705,255 | B2 * | 4/2010 | Yokote | H01H 13/06 200/302.2 |
| 8,796,574 | B2 * | 8/2014 | Kishi | H01H 13/42 200/467 |

FOREIGN PATENT DOCUMENTS

| | | | |
|---|---|---|---|
| DE | 3827638 | A1 | 3/1990 |
| DE | 9011926 | U1 | 11/1990 |
| JP | 63-047537 | U | 3/1988 |
| JP | 2012-64375 | A | 3/2012 |

OTHER PUBLICATIONS

European Office Action, dated May 4, 2020, for EP Application No. 19211532.7, 14 pages.
Chinese Office Action, dated Sep. 24, 2021, for CN Application No. 201911233263.6, 25 pages.

* cited by examiner

SNAP-ACTION SWITCH AND METHOD OF ASSEMBLING SAME

BACKGROUND

Technical Field

The present invention relates to a microswitch and method of assembling same.

Description of the Related Art

A miniature snap-action switch, also referred to as a micro-switch, is an electric switch comprising an actuator member such as a depressible plunger or button, which requires a relatively small amount of force to actuate it. Actuation of the plunger results in a snap-action or over-center type movement of the electrical contacts of the switch between normally opened and normally closed positions. Such switches are typically employed in precision control applications due to their reliability in effecting switching at specific and repeatable positions of the plunger.

Such switches are susceptible to ingress of particulates, dust and water at the aperture via which the plunger is depressed in to the switch housing and this may compromise the operation of the plunger or other parts of the switch within the housing. Certain existing snap-action switches employ a sealing cover which is secured to the housing to over the plunger to prevent ingress of such particulates in to the aperture. Due to the relatively small size of the miniature snap-action switch and its component parts, it is difficult to form the component parts and assemble the parts in a secure and efficient manner. Further, due to technical limitations in the ability to reliably form a relatively small part such as the sealing cover with the requisite degree of precision and in a cost-effective manner, the sealing cover is typically glued or ultrasonically welded to the housing to secure it in place. Unfortunately, the glue securing the sealing cover to the housing tends to fail over time resulting in detachment of the sealing cover from the housing. Ultrasonic welding is also undesirable as it creates a permanent bond between the sealing cover and the housing making it impracticable to remove the sealing cover from the housing to repair or modify the snap-action switch. Furthermore, in either case, only certain specific types of materials may be suitably glued or ultrasonically welded together in order to effect securement together, thus limiting the scope of materials that may be used in the switch.

A further problem associated with miniature snap-action switches is that due to the relatively small size of the component parts of a snap-action switch it is difficult to connect the plunger to a portion of the snap-action assembly within the housing with requisite precision. Moreover, due to the conventional design of miniature snap-action switches, the portion of the snap-action assembly within the housing to which the plunger is to be connected, is generally only accessible via the relatively small plunger aperture in the housing which. This makes it very difficult to maneuver the respective parts in to secured connection with each other in an easy, efficient and secure manner.

BRIEF SUMMARY

The present invention seeks to alleviate at least one of the above-described problems.

The present invention may involve several broad forms. Embodiments of the present invention may include one or any combination of the different broad forms herein described.

In one broad form, the present invention provides a snap-action switch including: a housing in which a plurality of fixed contacts and a plurality of movable contacts are disposed therein, a plunger configured for depressible movement via an aperture in the housing from a first position in which the plunger is relatively extended outwardly of the housing via the aperture, into, a second position in which the plunger is relatively retracted inwardly of the housing via the aperture; and a snap-action assembly operably-connected with the plunger, said snap-action assembly being responsive to depressible movement of the plunger so as to effect snap-action type movement of the plurality of movable contacts between normally opened and normally closed positions with respect to the fixed contacts; a sealing element configured for arrangement around the plunger to occlude ingress of particulates, dust and water from entering the housing via the aperture, said sealing element including a flanged portion; and a securement element configured for arrangement around the sealing element, wherein said securement element is shaped and dimensioned for interference fitting or snap-fitting with a rim of the aperture whereby the flanged portion of the sealing element is secured between the securement element and the rim of the aperture so as to restrict removal of the sealing element from the housing.

Preferably, the plunger may include a recess disposed in a first end, said recess being shaped and dimensioned for snap-fitting engagement with a barbed element disposed on a portion of the snap-action assembly within the housing such that the plunger is suitably secured to the snap-action assembly for operation with the snap-action assembly.

Preferably, the plunger may include a barbed element disposed in a first end, said barbed element being shaped and dimensioned for snap-fitting engagement with a recess disposed on a portion of the snap-action assembly within the housing such that the plunger is suitably secured to the snap-action assembly for operation with the snap-action assembly.

Preferably, the sealing element may include an elastically-resilient polymeric material.

Preferably, at least one of the plunger and the securement element may include a nylon material.

Preferably, the sealing element may include a sleeve having an opening at a first end and an opening at a second end, said flanged portion extending away from a rim of the opening at the first end, and a periphery of the plunger being configured for snug-fitting engagement with a rim of the opening at the second end of the sleeve.

Preferably, the plunger, the sealing element and the securement element may include annular configurations and are configured for coaxial arrangement relative to each other.

Preferably, the securement element may include a plurality of space-apart tabs extending away from an annular periphery of the securement element, said plurality of spaced-apart tabs being configured for friction fitting with the rim of the aperture in the housing whereby the flanged portion of the sealing element is secured between the securement element and the rim of the aperture so as to restrict removal of the sealing element from the housing.

In another broad form, the present invention provides a snap-action switch including: a housing in which a plurality of fixed contacts and a plurality of movable contacts are disposed therein, a plunger configured for depressible movement via an aperture in the housing from a first position in which the plunger is relatively extended outwardly of the housing via the aperture, into, a second position in which the plunger is relatively retracted inwardly of the housing via the aperture; and a snap-action assembly operably-connected with the plunger, said snap-action assembly being responsive to depressible movement of the plunger so as to effect snap-action type movement of the plurality of movable contacts between normally opened and normally closed positions with respect to the fixed contacts; a sealing element configured for arrangement around the plunger to occlude ingress of particulates, dust and water from entering the housing via the aperture, said sealing element including a flanged portion; and a securement element configured for arrangement around the sealing element so as to secure the sealing element between the securement element and the rim of the aperture so as to restrict removal of the sealing element from the housing; wherein the plunger includes a recess disposed in a first end, said recess being shaped and dimensioned for snap-fitting engagement with a barbed element disposed on a portion of the snap-action assembly within the housing such that the plunger is suitably secured to the snap-action assembly for operation with the snap-action assembly.

Alternately, instead of the recess being disposed in the first end of the plunger and the barbed element being disposed on the portion of the snap-action assembly, the barbed element may be disposed in the first end of the plunger and the recess is disposed in the portion of the snap-action assembly.

Preferably, the securement element may be shaped and dimensioned for interference fitting or snap-fitting with a rim of the aperture whereby the flanged portion of the sealing element is secured between the securement element and the rim of the aperture so as to restrict removal of the sealing element from the housing.

Preferably, the sealing element may include an elastically-resilient polymeric material.

Preferably, at least one of the plunger and securement element may include a nylon material.

Preferably, the sealing element may include a sleeve having an opening at a first end and an opening at a second end, said flanged portion extending away from a rim of the opening at the first end, and a periphery of the plunger being configured for snug-fitting engagement with a rim of the opening at the second end of the sleeve.

Preferably, the plunger, the sealing element and the securement element may include annular configurations and are configured for coaxial arrangement relative to each other.

Preferably, the securement element may include a plurality of space-apart tabs extending away from an annular periphery of the securement element, said plurality of spaced-apart tabs being configured for friction fitting with the rim of the aperture in the housing whereby the flanged portion of the sealing element is secured between the securement element and the rim of the aperture so as to restrict removal of the sealing element from the housing.

In another broad form, the present invention provides a method of assembling a snap-action switch, said snap-action switch including: a housing in which a plurality of fixed contacts and a plurality of movable contacts are disposed therein, a plunger configured for depressible movement via an aperture in the housing from a first position in which the plunger is relatively extended outwardly of the housing via the aperture, into, a second position in which the plunger is relatively retracted inwardly of the housing via the aperture; and a snap-action assembly operably-connected with the plunger, said snap-action assembly being responsive to depressible movement of the plunger so as to effect snap-action type movement of the plurality of movable contacts between normally opened and normally closed positions with respect to the fixed contacts; a sealing element configured for arrangement around the plunger to occlude ingress of particulates, dust and water from entering the housing via the aperture, said sealing element including a flanged portion; and a securement element configured for arrangement around the sealing element, wherein said securement element is shaped and dimensioned for interference fitting or snap-fitting with a rim of the aperture whereby the flanged portion of the sealing element is secured between the securement element and the rim of the aperture so as to restrict removal of the sealing element from the housing; wherein said method includes steps of:

forming a barbed element on a portion of the snap action assembly;

forming a recess in a first end of the plunger, said recess being shaped and dimensioned for interference-fitting or snap-fitting engagement with the barbed element disposed on the portion of the snap-action assembly; and effecting interference-fitting or snap-fitting engagement of the plunger recess on to the barbed element of the portion of the snap-action assembly such that the plunger is suitably secured to the snap-action assembly for operation with the snap-action assembly.

Alternately, the present invention may include alternate steps of:

(i) forming a barbed element on a first end of the plunger;

(ii) forming a recess in a portion of the snap action assembly, said recess being shaped and dimensioned for interference-fitting or snap-fitting engagement with the barbed element disposed on the portion of the snap-action assembly; and (iii) effecting interference-fitting or snap-fitting engagement of the barbed element on the plunger in to the recess in the portion of the snap-action assembly such that the plunger is suitably secured to the snap-action assembly for operation with the snap-action assembly.

It would be appreciated from the above broad forms that the present invention may assist in providing advantages over the existing art. One such advantage is that the present invention is more flexible over the cited art as a wider range of materials may be utilized as the sealing element and the housing to effect securement as ultrasonic welding and gluing is not involved. Furthermore, as the sealing element is not permanently bonded to the housing, it is possible to remove the sealing element from the housing if necessary to fix or modify the snap-action switch. Yet further, as the sealing element, securement member and housing, may be formed from nylon and/or resilient elastomeric polymeric materials and the like, such parts may be relatively easily, efficiently and cost-effectively mass-produced using molding techniques. With advancements in the fabrication of small parts such as those used in the context of miniature snap-action switches, it is now also possible mold a element with the requisite degree of precision to allow it to be secured by way of interference fitting or snap-fitting engagement. Yet further, in certain embodiment, the plunger may be quickly and easily coupled to the portion of the snap-action assembly by simply pressing the plunger through the aperture in to engagement with the portion of the snap-action assembly so that they snap-fit together.

BRIEF DESCRIPTION OF THE SEVERAL VIEWS OF THE DRAWINGS

The present invention will become more fully understood from the following detailed description of a preferred but non-limiting embodiments thereof, described in connection with the accompanying drawings, wherein.

DETAILED DESCRIPTION

Figure 1A:
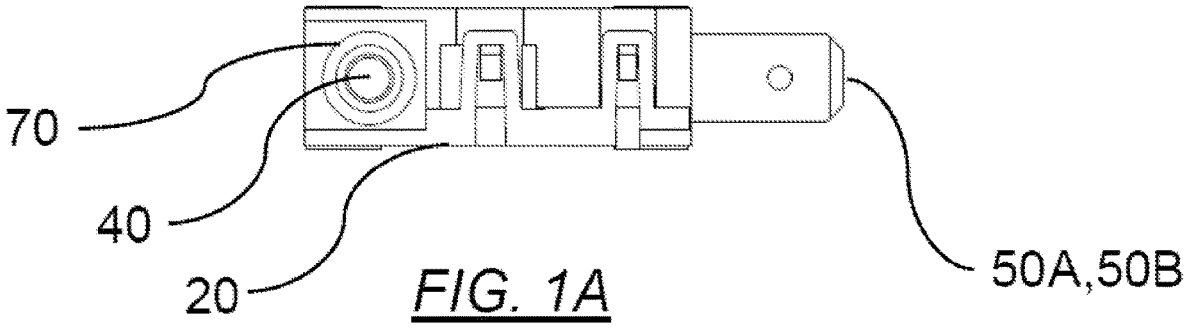
FIG. 1A shows a top-view of a snap-action switch in accordance with an embodiment of the present invention.
Figure 1B:
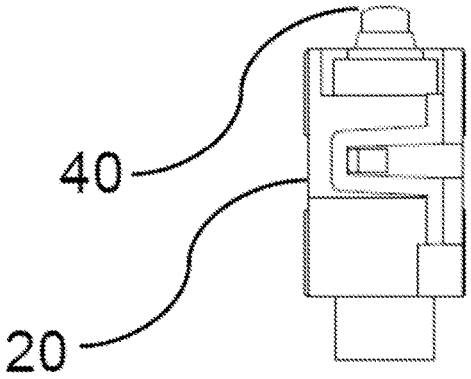
FIG. 1B shows a first side-view of a snap-action switch in accordance with an embodiment of the present invention.
Figure 1C:
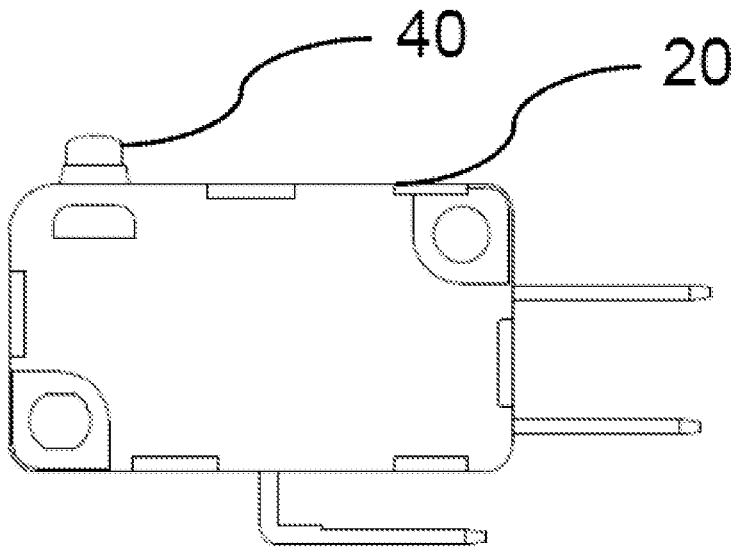
FIG. 1C shows a rear-view of a snap-action switch in accordance with an embodiment of the present invention.
Figure 1D:
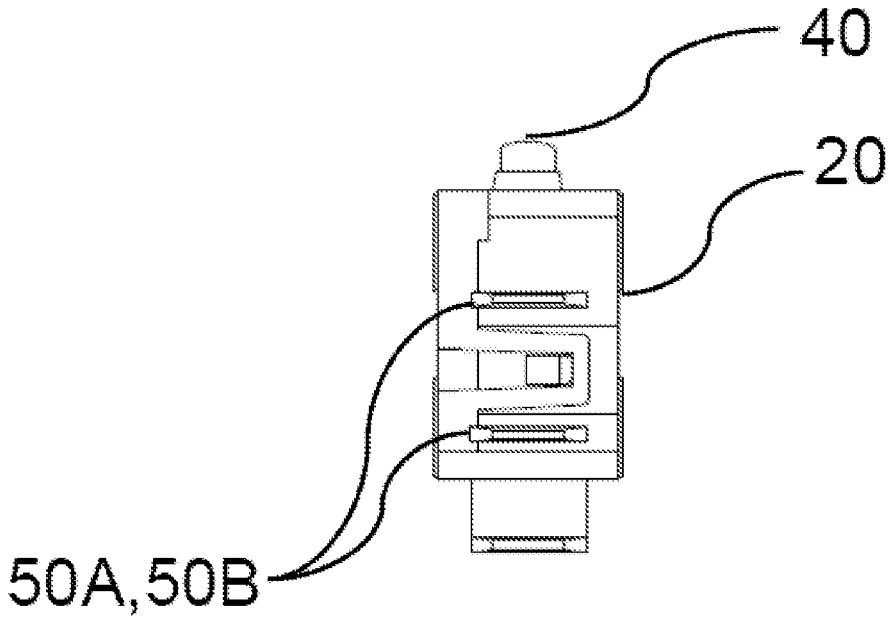
FIG. 1D shows a second side-view of a snap-action switch in accordance with an embodiment of the present invention.
Figure 1E:
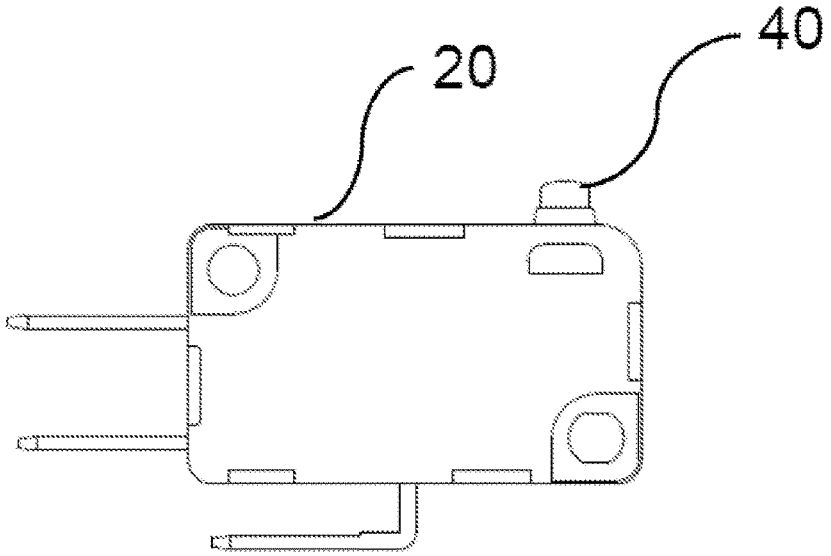
FIG. 1E shows a front-view of a snap-action switch in accordance with an embodiment of the present invention.
Figure 1F:
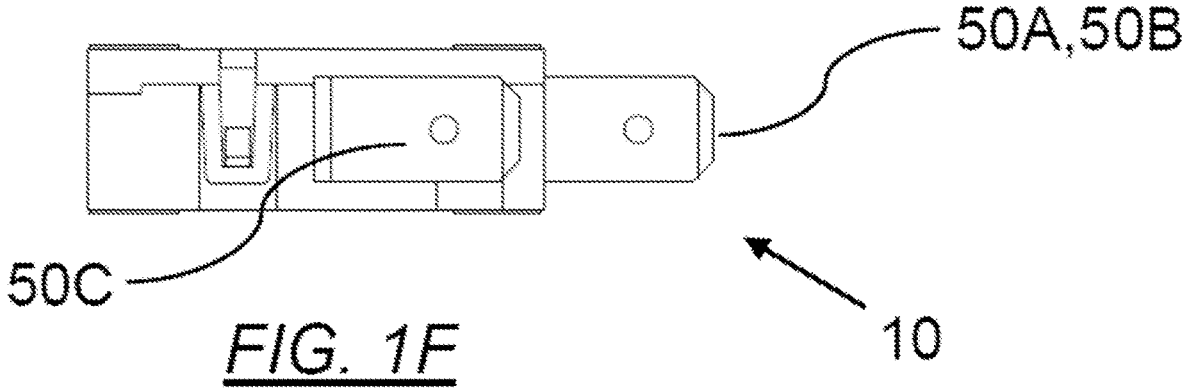
FIG. 1F shows a bottom-view of a snap-action switch in accordance with an embodiment of the present invention.
Figure 2A:
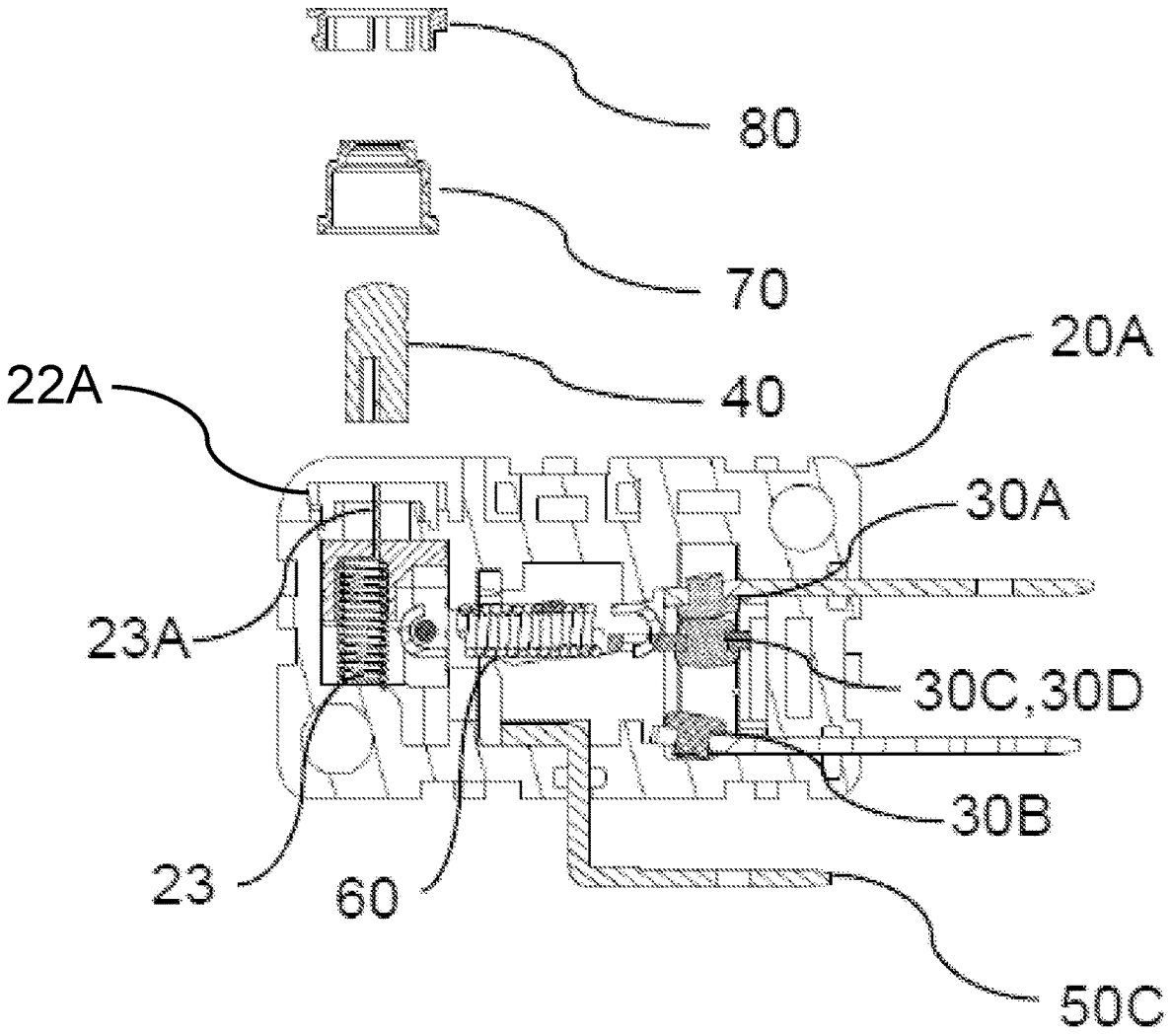
FIG. 2A shows a rear cutaway-view of a snap-action switch in accordance with an embodiment of the present invention in which the plunger, sealing element and securement element are shown in an exploded view.
Figure 2B:
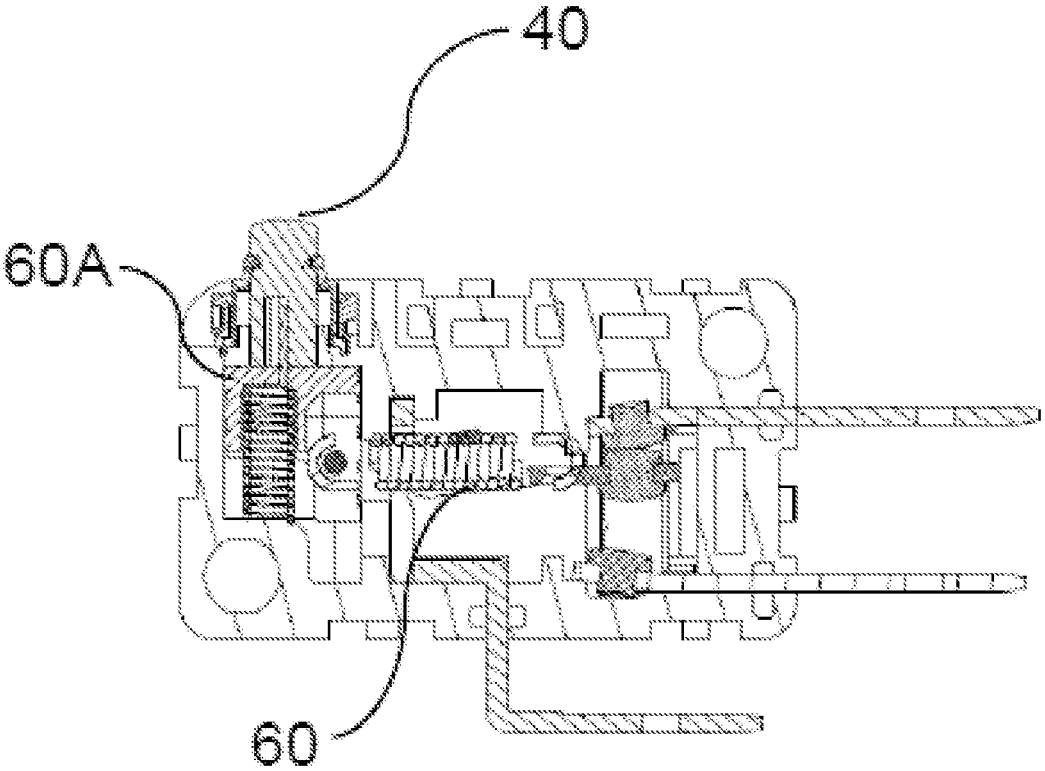
FIG. 2B shows a rear cutaway-view of a snap-action switch in accordance with an embodiment of the present invention in which the plunger, sealing element and securement element are shown assembled together.
Figure 2C:
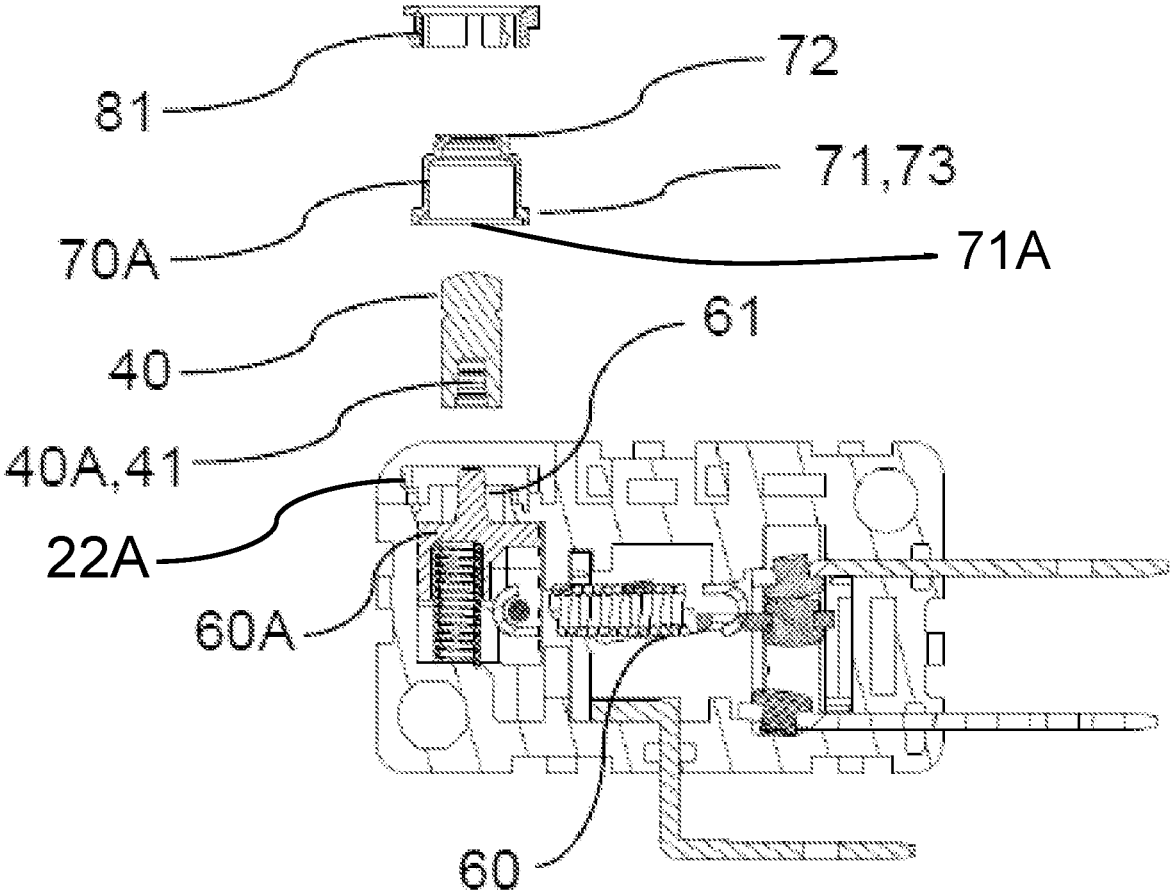
FIG. 2C shows another rear cutaway-view of a snap-action switch in accordance with an embodiment of the present invention in which the plunger, sealing element and securement element are shown assembled together.
Figure 3A:
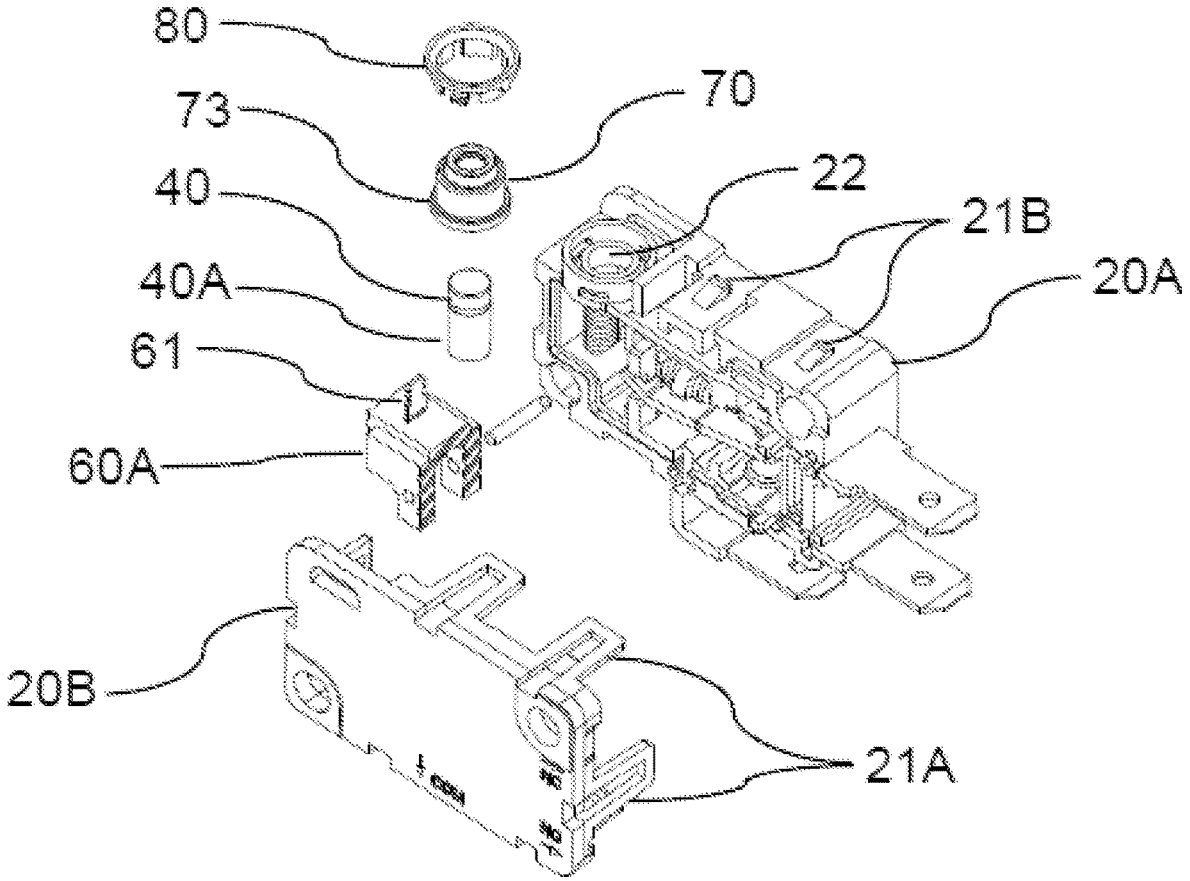
FIG. 3A shows a rear perspective exploded view of a snap-action switch in accordance with an embodiment of the present invention.
Figure 3B:
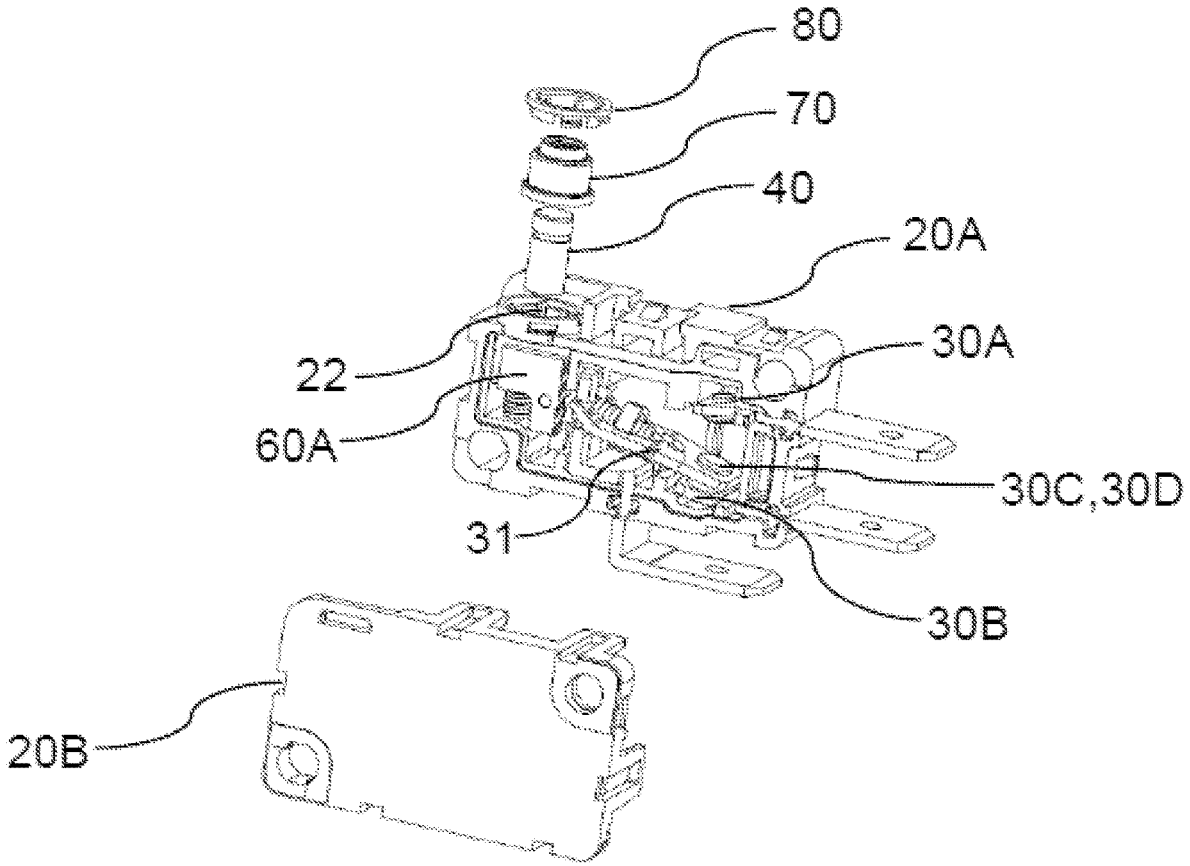
FIG. 3B shows another rear perspective exploded view of a snap-action switch in accordance with an embodiment of the present invention.
Figure 3C:
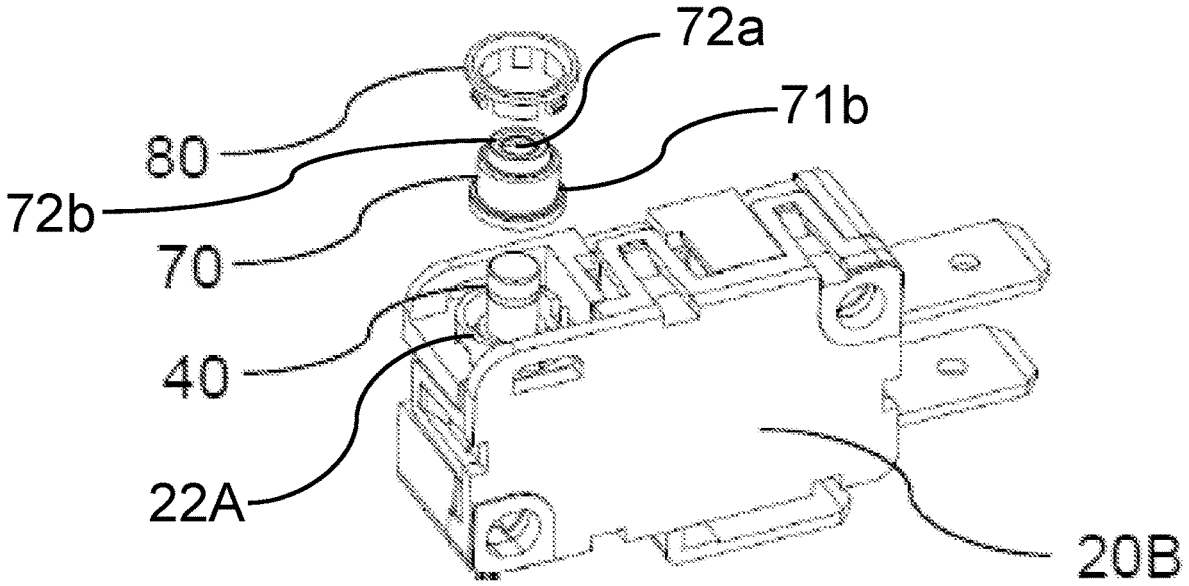
FIG. 3C shows yet another rear perspective exploded view of a snap-action switch in accordance with an embodiment of the present invention in which the first and second shells of the housing are snap-fitted together.
Figure 4:
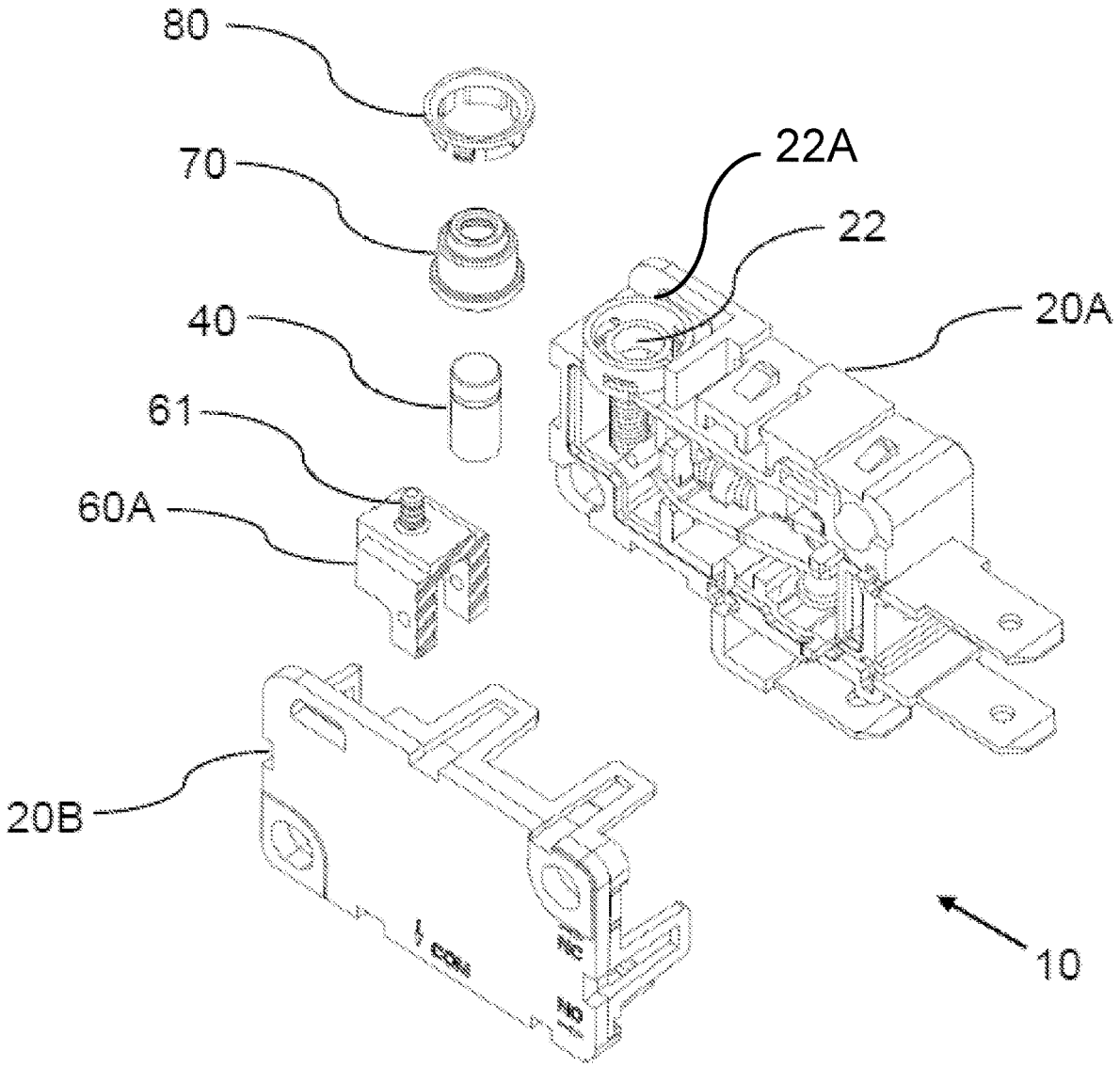
FIG. 4 shows yet another rear perspective exploded view of a snap-action switch in accordance with an embodiment of the present invention.
Figure 4:
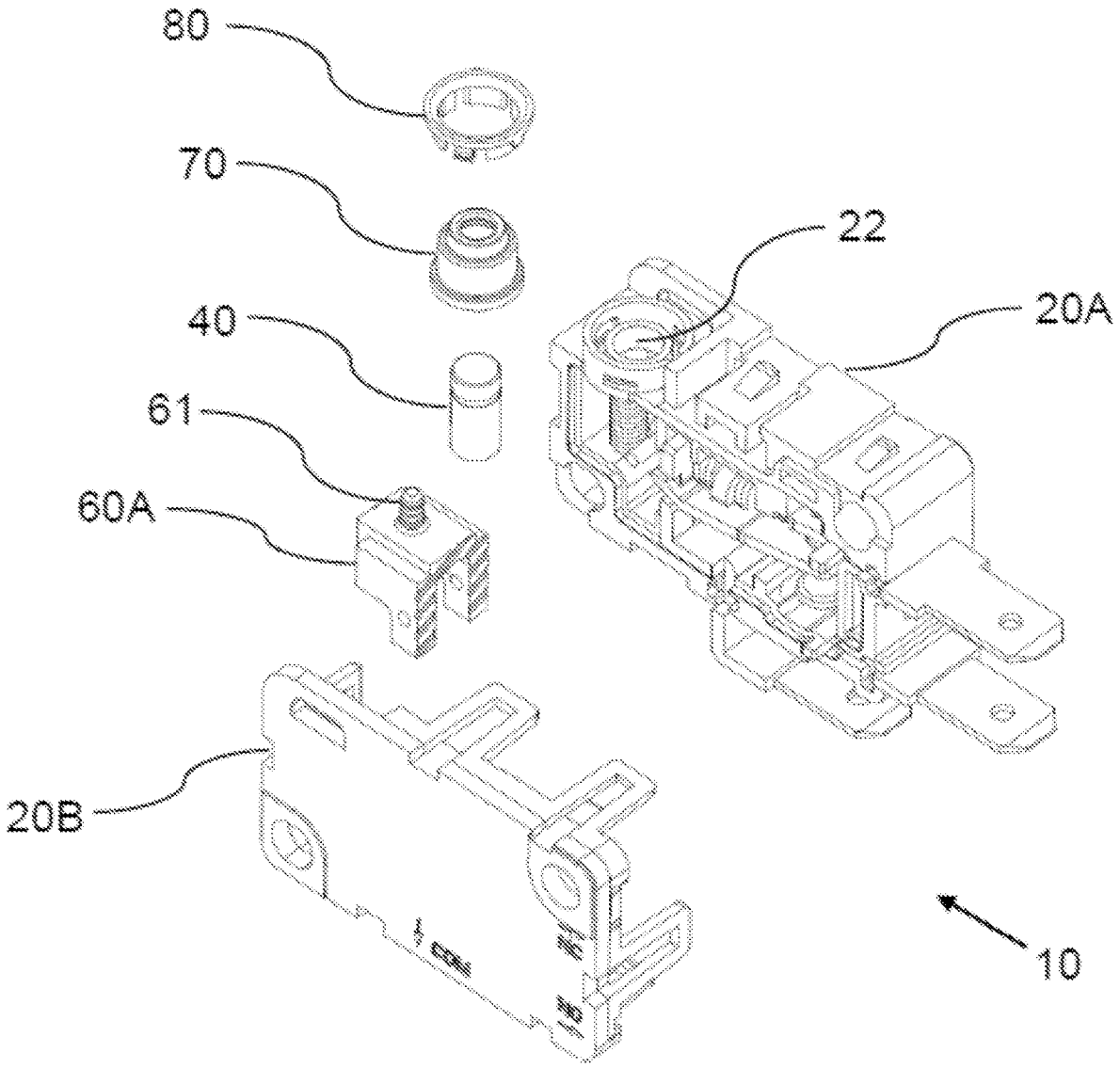

Preferred embodiments of a miniature snap-action switch 10 in accordance with the present invention will now be described herein with reference to FIGS. 1 to 4.

The snap-action switch 10 includes a housing 20 in which a plurality of fixed contacts 30A, 30B and a plurality of movable contacts 30C, 30D mounted on a contact lever 31 are disposed therein. The housing 20 is made from a rigid nylon material or any other suitably rigid material. The housing 20 includes a first shell 20A which includes a chamber within which the internal component parts of the switch are seated therein. A second shell 20B of the housing 20 includes engagement tabs 21A that are configured for snap-fitting engagement with corresponding engagement nubs 21B disposed on the first shell 20A.

The housing 20 includes a cylindrical-shaped plunger 40 configured for depressible movement via a circular-shaped aperture 22 in the top of the housing 20 from a first position in which the plunger 40 is relatively extended outwardly of the housing aperture 22, into, a second position in which the plunger 40 is relatively retracted inwardly of the housing 20 via the aperture 22. A return spring 23 is operably-connected with the plunger 40 so as to return the plunger 40 in to the relatively extended position after being inwardly depressed. Electrical terminals 50A, 50B, 50C extend outwardly of the housing 20 as shown in the drawings.

A first end 40A of the plunger 40 is operably-connected with a portion 60A of the snap-action assembly 60 located within the housing 20. The snap-action assembly 60 is responsive to depressible movement of the plunger 40 so as to effect snap-action type movement of the plurality of movable contacts 30C, 30D between normally opened and normally closed positions with respect to the fixed contacts 30A, 30B. During assembly of the snap-action switch 10, a first end 40A of the plunger 40 is formed with a recess 41 disposed therein that is shaped and dimensioned for snap-fitting engagement with a barbed element 61 formed on the portion 60A of the snap-action assembly 60 within the housing 20. The first end 40A of the plunger 40 is pressed downwardly in to the aperture 22 and into snap-fitting engagement with the barbed element 61 on the portion 60A of the snap-action assembly 60 to suitably secure them together. In alternate embodiments, it may be possible to instead form the barbed element on the first end of the plunger and the recess on the portion of the snap-action assembly instead. The recess 41 in the plunger 40 is also configured for securely receiving an end 23A of the return spring 23 therein so that the plunger 40 and return spring 230 may be operably-connected together.

A sealing element 70 is configured for arrangement around the plunger 40 to occlude ingress of particulates, dust and water from entering the housing 20 via the aperture 22. The sealing element 22 includes a sleeve 70A having an opening (71*a*) at a first end 71 and an opening (72*a*) at a second end 72. The sealing element 70A is configured for fitting over the plunger 40 so that a flanged portion 73 extending away from a rim (71*b*) of the opening (71*a*) at the first end 71 of the sleeve 70A is able to be secured to the housing 20, and, a periphery of the plunger 40 is configured for snug-fitting engagement with a rim (72*b*) of the opening (72*a*) at the second end 72 of the sleeve 70A.

A circular-shaped securement element 80 is configured for fitting over the plunger 40 and the sealing element 70. Accordingly, the diameter of the securement element 80 is wider than that of the plunger 40 and similar to that of the flanged portion 73 of the sealing element 70. The securement element 80 includes a plurality of tabs 81 or flaps that extend away from a rim of the securement element 80 at spaced-apart intervals. The tabs 81 are shaped-and dimensioned so that the securement element 80 can be pressed against the flanged portion 73 of the sealing element 70 and then in to interference fitting or snap-fitting engagement with the rim of the housing aperture 22 to secure the securement element 80 to the housing 20. In this secured arrangement, the flanged portion 73 of the sealing element 70 is also secured between the securement element 80 and the rim (22*a*) of the aperture 22 so as to restrict removal of the sealing element 70 from the housing 20.

In this embodiment, the sealing element 70 is molded from an elastically-resilient polymeric material whilst the plunger 40 and the securement element 80 are formed from a rigid nylon material. In other embodiments, it is possible to utilize alternate materials which may function in a similar manner as described herein within the context of a snap-action switch device.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A snap-action switch including:

a housing in which a plurality of fixed contacts and a plurality of movable contacts are disposed therein, a plunger configured for depressible movement via an aperture in the housing from a first position in which the plunger is extended outwardly of the housing via the aperture, to, a second position in which the plunger is retracted inwardly of the housing via the aperture;

a return spring for biasing the plunger so that the plunger extends outwardly of the housing;

a snap-action assembly operably connected with the plunger, the snap-action assembly being responsive to depressible movement of the plunger so as to effect snap-action movement of the plurality of movable contacts between normally opened and normally closed positions with respect to the plurality of fixed contacts;

a sealing element configured for arrangement around the plunger to occlude ingress of particulates, dust and water from entering the housing via the aperture, the sealing element including a flanged portion; and a securement element configured for arrangement around the sealing element, wherein the securement element is shaped and dimensioned for interference fitting or snap-fitting with a rim of the aperture whereby the flanged portion of the sealing element is secured between the securement element and the rim of the aperture so as to restrict removal of the sealing element from the housing;

wherein the snap-action switch is characterized in that the plunger includes a recess disposed in a first end, the recess being shaped and dimensioned for snap-fitting engagement with a barbed element disposed on a portion of the snap-action assembly within the housing such that the plunger is suitably secured to the snap-action assembly for operation with the snap-action assembly, and, wherein the recess is further configured for receiving an end of the return spring therein so that the plunger and the return spring are operably connected together.

2. The snap-action switch as claimed in claim 1 wherein the sealing element includes an elastically-resilient polymeric material.

3. The snap-action switch as claimed in claim 1 wherein at least one of the plunger and the securement element includes a nylon material.

4. The snap-action switch as claimed in claim 1 wherein the sealing element includes a sleeve having an opening at a first end and an opening at a second end, the flanged portion extending away from a rim of the opening at the first end of the sleeve, and a periphery of the plunger being configured for snug-fitting engagement with a rim of the opening at the second end of the sleeve.

5. The snap-action switch as claimed in claim 1 wherein the plunger, the sealing element and the securement element include annular configurations and are configured for coaxial arrangement relative to each other.

6. The snap-action switch as claimed in claim 1 wherein the securement element includes a plurality of spaced-apart tabs extending away from an annular periphery of the securement element, the plurality of spaced-apart tabs being configured for friction fitting with the rim of the aperture in the housing whereby the flanged portion of the sealing element is secured between the securement element and the rim of the aperture so as to restrict removal of the sealing element from the housing.

7. A snap-action switch including:

a housing in which a plurality of fixed contacts and a plurality of movable contacts are disposed therein, a plunger configured for depressible movement via an aperture in the housing from a first position in which the plunger is extended outwardly of the housing via the aperture, to, a second position in which the plunger is retracted inwardly of the housing via the aperture;

a return spring for biasing the plunger so that the plunger extends outwardly of the housing;

a snap-action assembly operably connected with the plunger, the snap-action assembly being responsive to depressible movement of the plunger so as to effect snap-action movement of the plurality of movable contacts between normally opened and normally closed positions with respect to the plurality of fixed contacts;

a sealing element configured for arrangement around the plunger to occlude ingress of particulates, dust and water from entering the housing via the aperture, the sealing element including a flanged portion; and a securement element configured for arrangement around the sealing element so as to secure the sealing element between the securement element and a rim of the aperture so as to restrict removal of the sealing element from the housing;

wherein the snap-action switch is characterized in that the plunger includes a recess disposed in a first end, the recess being shaped and dimensioned for snap-fitting engagement with a barbed element disposed on a portion of the snap-action assembly within the housing such that the plunger is suitably secured to the snap-action assembly for operation with the snap-action assembly, and, wherein the recess is further configured for receiving an end of the return spring therein so that the plunger and the return spring are operably connected together.

8. The snap-action switch as claimed in claim 7 wherein the recess is disposed in the first end of the plunger and the barbed element is disposed on the portion of the snap-action assembly, the barbed element is disposed in the first end of the plunger and the recess is disposed in the portion of the snap-action assembly.

9. The snap-action switch as claimed in claim 7 wherein the securement element is shaped and dimensioned for interference fitting or snap-fitting with the rim of the aperture whereby the flanged portion of the sealing element is secured between the securement element and the rim of the aperture so as to restrict removal of the sealing element from the housing.

10. The snap-action switch as claimed in claim 7 wherein the sealing element includes an elastically-resilient polymeric material.

11. The snap-action switch as claimed in claim 7 wherein at least one of the plunger and the securement element includes a nylon material.

12. The snap-action switch as claimed in claim 7 wherein the sealing element includes a sleeve having an opening at a first end and an opening at a second end, the flanged portion extending away from a rim of the opening at the first end of the sleeve, and a periphery of the plunger being configured for snug-fitting engagement with a rim of the opening at the second end of the sleeve.

13. The snap-action switch as claimed in claim 7 wherein the plunger, the sealing element and the securement element include annular configurations and are configured for coaxial arrangement relative to each other.

14. The snap-action switch as claimed in claim 7 wherein the securement element includes a plurality of spaced-apart tabs extending away from an annular periphery of the securement element, the plurality of spaced-apart tabs being configured for friction fitting with the rim of the aperture in the housing whereby the flanged portion of the sealing element is secured between the securement element and the rim of the aperture so as to restrict removal of the sealing element from the housing.

15. A method of assembling a snap-action switch, the snap-action switch including:

a housing in which a plurality of fixed contacts and a plurality of movable contacts are disposed therein, a plunger configured for depressible movement via an aperture in the housing from a first position in which the plunger is extended outwardly of the housing via the aperture, to, a second position in which the plunger is retracted inwardly of the housing via the aperture;

a return spring for biasing the plunger so that the plunger extends outwardly of the housing;

a snap-action assembly operably-connected with the plunger, the snap-action assembly being responsive to depressible movement of the plunger so as to effect snap-action movement of the plurality of movable contacts between normally opened and normally closed positions with respect to the plurality of fixed contacts;

a sealing element configured for arrangement around the plunger to occlude ingress of particulates, dust and water from entering the housing via the aperture, the sealing element including a flanged portion; and a securement element configured for arrangement around the sealing element, wherein the securement element is shaped and dimensioned for interference fitting or snap-fitting with a rim of the aperture whereby the flanged portion of the sealing element is secured between the securement element and the rim of the aperture so as to restrict removal of the sealing element from the housing; wherein the method includes steps of:

i. forming a barbed element on a portion of the snap action assembly;

ii. forming a recess in a first end of the plunger, the recess being shaped and dimensioned for interference-fitting or snap-fitting engagement with the barbed element disposed on the portion of the snap-action assembly;

iii. effecting interference-fitting or snap-fitting engagement of the recess on to the barbed element of the portion of the snap-action assembly such that the plunger is suitably secured to the snap-action assembly for operation with the snap-action assembly; and iv. receiving an end of the return spring into the recess so that the plunger and the return spring are operably connected together.

* * * * *